United States Patent [19]

McCabe

[11] 3,977,456

[45] Aug. 31, 1976

[54] VOLUME CONTROLLED DAMPER

[76] Inventor: Francis J. McCabe, 239 Hastings Court, Doylestown, Pa. 18901

[22] Filed: Jan. 20, 1975

[21] Appl. No.: 542,168

[52] U.S. Cl. ..... 160/1; 160/9; 160/84 R

[51] Int. Cl.[2] ..... E05F 15/20

[58] Field of Search ..... 160/1–9, 160/84 R, 166–171; 137/77, 75

[56] References Cited

UNITED STATES PATENTS

| | | | |
|---|---|---|---|
| 2,596,413 | 5/1952 | Kincaid | 160/1 R |
| 3,401,734 | 9/1968 | McCabe | 160/1 X |
| 3,439,725 | 4/1969 | Haimovitz et al. | 160/84 R |
| 3,734,114 | 5/1973 | Phillips | 160/84 R X |
| 3,796,249 | 3/1974 | McCabe | 160/1 |

*Primary Examiner*—Philip C. Kannan
*Attorney, Agent, or Firm*—Frank J. Benasutti Associates, Ltd.

[57] ABSTRACT

A combination grill, air damper and fire damper is provided with a means for adjusting the volume of flow of air through the damper.

4 Claims, 5 Drawing Figures

VOLUME CONTROLLED DAMPER

BACKGROUND OF THE INVENTION

This invention relates to dampers for air circulating systems, and in particular, to a combination of air controlling elements for use at the open end of the air handling system.

In the prior art, it is known to use air diffusers, such as grates and the like, across the open end of an air duct positioned in a wall or ceiling. It is also known to provide at some point in the air duct a fire damper, which will automatically close, usually upon actuation of a link, to restrict the flow of air through the duct under elevated temperature conditions, such as those existing during a fire.

In many air systems, it is necessary to balance the air flow, that is, to adjust the volume of air going through various air ducts. In such systems, it may be necessary to employ baffles in order to control the air flow.

In recent years, devices have been developed for re-setting fire dampers once they have been actuated and for withdrawing the resettable mechanism from outside of the damper frame by motor operated means. See, for example, the James R. Root U.S. Pat. No. 3,580,321, wherein the damper comprises a plurality of blades held in a standby position by an energized motor. The blades automatically move to the closed position when the electrical energy to the motor is interrupted. See also, my U.S. Pat. No. 3,866,656 issued Feb. 18, 1975, for folding blade fire damper (Ser. No. 357,000, filed May 3, 1973), for an improvement in such a device wherein a supplemental spring motor overcomes the frictional forces inherent in the gear operated motor. In such devices, as in all fire dampers, the folding blade damper is normally held in the open condition with the blades folded, so that it is ready to close under fire conditions. Under fire conditions, it is fully closed, that is, the blades are unfolded completely.

SUMMARY OF THE INVENTION

In the present invention, I provide for the first time, in combination, a plurality of air control elements, which in effect form an air valve in the air duct; which air valve is adjustably controlled to a plurality of positions for volume control, and is also a fully operative fire damper. The elements comprise a folding blade damper having a frame and a plurality of blades movable between a folded open condition and an unfolded closed condition, a retracting means to move the blades from the unfolded to the folded condition, a releasible link in the retractible means to release the blades and permit them to move to the unfolded closed condition, and a volume controller engaging the retracting means to retain the retracting means in a plurality of positions, and thereby retain the blades in a plurality of positions between fully opened and fully closed.

In the simplest and preferred embodiment of this invention, the volume controller comprises a manually operative device accessible from outside the grill which extends across the opening in the air duct. Such a device will be described more fully hereinafter.

Accordingly, it is an object of my invention to provide in combination an air control valve and fire damper for use particularly at the terminus of an air duct. This and other objects of my invention will become apparent from the following description with reference to the accompanying drawings.

DESCRIPTION OF THE PREFERRED EMBODIMENT

Figure 1:
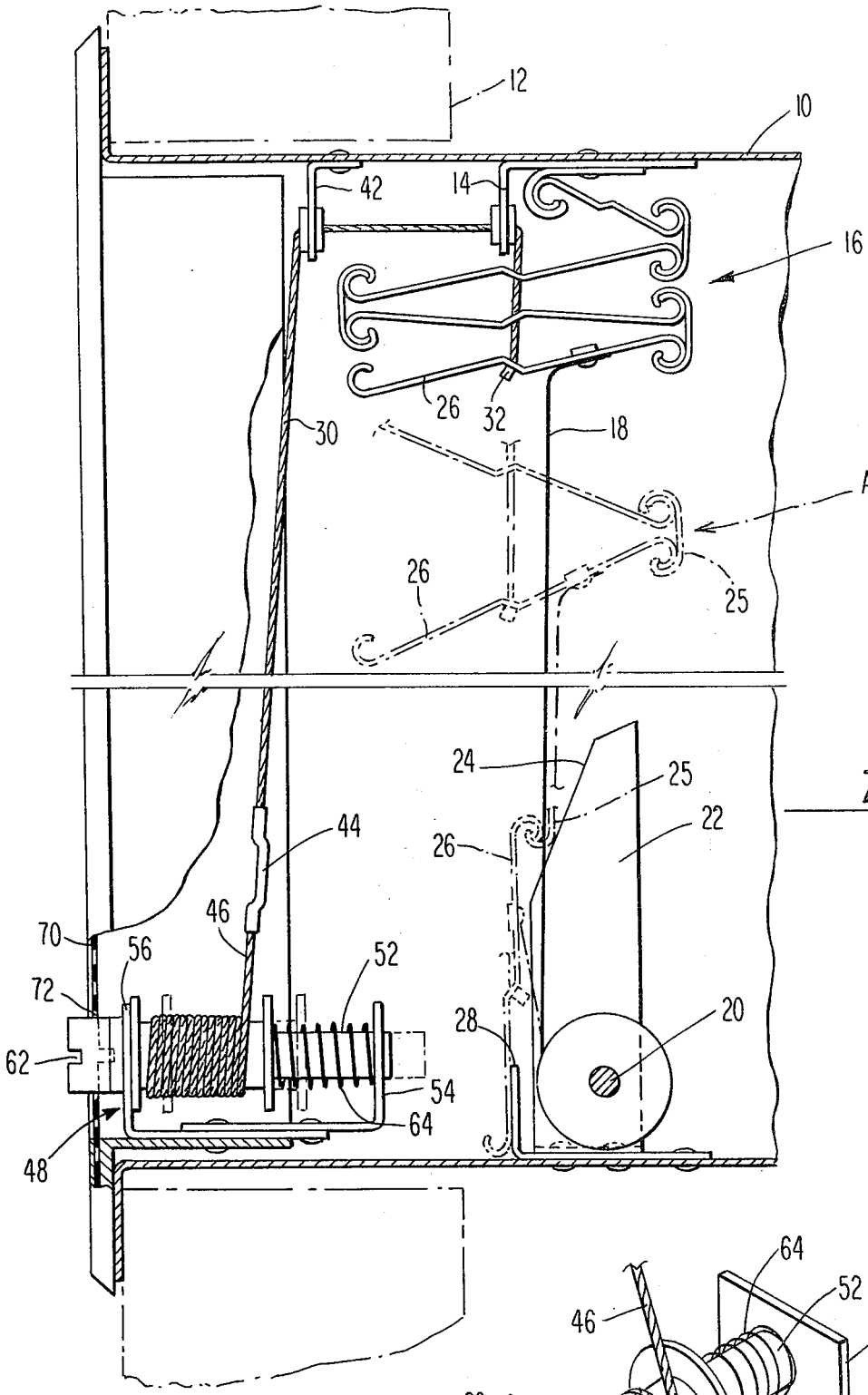
FIG. 1 is an elevation of an air diffuser and duct partially broken away and shown in section, shown in combination with a volume control and fire damper combination, shown in cross section, with alternate positions shown in phantom lines; the whole being shown in operative environmental relation to the wall wherein it is mounted, said wall being shown in phantom lines; the whole being foreshortened for the sake of clarity.

Although specific forms of the invention have been selected for illustration in the drawings, and the following description is drawn in specific terms for the purpose of describing these forms of the invention, this description is not intended to limit the scope of the invention which is defined in the appended claims.

Referring to FIG. 1, the preferred embodiment of the invention is shown, comprising a combination of volume controller and fire damper mounted in a duct 10, shown in its environmental relation to a partition or a wall 12. The damper comprises a frame and a plurality of blades designated generally 16, which are articulated with respect to one another so that they can be moved between an opened folded condition which allows air to pass through the frame, and a closed unfolded condition which substantially restricts the passage of air through the frame. Such devices have been known, as for example, shown in my original U.S. Pat. No. 3,401,734, issued Sept. 17, 1968, covering an articulated barrier.

In the device shown, a spring 18 is connected to the end blade and mounted about a shaft 20 so that the blades can be moved from the folded condition shown in full lines to an unfolded condition, such as the intermediate position shown in phantom lines designated A. An example of such a spring can be found in my U.S. Pat. No. 3,814,165, issued June 4, 1974, for a fire damper and method of fabricating same.

To aid the blades in coming to a fully closed position, so that the blades press against the inwardly depending side flanges (described more fully in my prior patents referenced above), I have provided a sloping cam 22 having a surface 24 which engages the surface of the connecting member 25 articulated to the last blade 26, and by pivoting the blade about its intermediate web portion, urges the terminal blade portion toward and against the upright portion of the bottom inwardly depending flange 28. This cam is conveniently mounted to the frame in any suitable manner, as by rivets. In this manner, the bottom blade, and indeed the remaining blades, are securely clamped to substantially impede the flow of air through the duct.

The retracting means for the blades comprises a cable 30 which extends through holes in each of the blades. The cable has a stop 32 crimped to one end. The stop is large enough so that it will not pass through the blade 26, and therefore, the blade will be drawn upwardly when the cable is retracted vertically.

Figure 5:
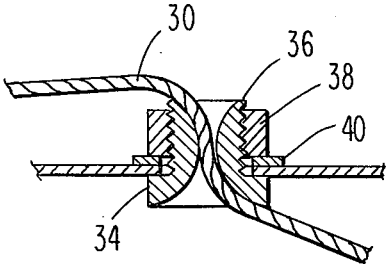
FIG. 5 is an enlarged section of a portion of the device shown in FIG. 4, taken as indicated by the lines and arrows 5—5 in FIG. 4.

A plurality of ferrules, such as are shown in greater detail in FIG. 5, are provided for threading the cable through portions of the surrounding structure. Referring to FIG. 5, each ferrule comprises a generally cylindrical part 34 having a threaded portion 36 extending therefrom so as to form a shoulder with the cylindrical portion 34, and having a central passageway therethrough, being generally conic from both ends, or Venturi-like when viewed in section, as shown in FIG. 5. This provides smooth surfaces about which the cable 30 can pass, as clearly illustrated. A nut 38 and washer 40 provide a suitable means in conjunction with a portion 36 for fastening the ferrule to the sheet metal portion of the structure through which it is passing. The designation 30 has been used in both figures, since the cable is essentially the same, although it is positioned differently in the embodiment shown in FIG. 3 from the embodiment shown in FIG. 1.

Referring again to FIG. 1, it will be noted that a plurality of such ferrules are provided passing through the flanges 14 and 42.

A link 44, which may be a fusible link or a manually resettable link, such as shown in my prior U.S. Pat. No. 3,725,972, issued Apr. 10, 1973, for fire link and method of actuating same, is provided interconnecting portions of the cable 30.

Figure 2:
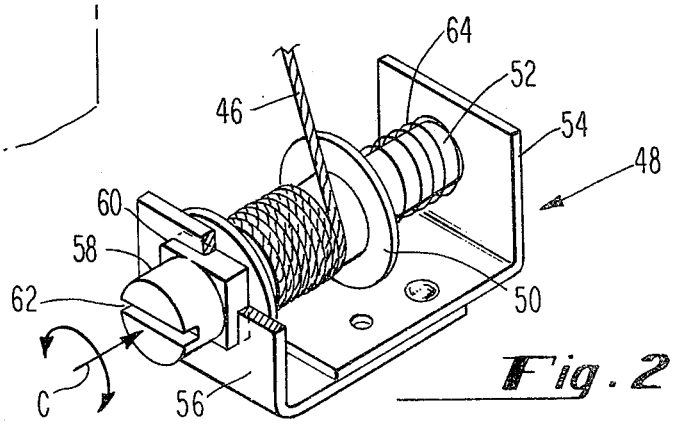
FIG. 2 is a perspective view of a portion of the device shown in FIG. 1, shown partially in section.

The second portion of the cable, designated 46, is connected to the volume controller, designated generally 48. This controller is shown in greater detail in FIG. 2. Referring to both figures, it will be noted that the controller comprises a spool 50 formed concentrically on a main shaft 52, which has one extending through a flange 54 to rotate therein and the other end extending through a flange 56. The end passing through the flange 56 has an end portion which is cylindrical and slotted, and is designated 58, and an intermediate portion abutting the spool which is square, and is designated 60. The square portion is at least as large as the diameter of the cylindrical portion 58. The square portion fits into a hole in the flange 56, which is of such dimension as to prevent the square portion from turning therein. The slot 62 is designed for reception of an instrument such as a screwdriver. A spring 64 is provided about the shaft 52 in compression between the flange 54 and the end of the spool, as shown in FIG. 1. Thus, the spool is naturally forced to the left when viewed as in FIG. 1.

In operation, the volume controller will maintain the position of the blades in a plurality of positions, so long as the square portion 60 is positioned in the flange 56. To move the blades from one position to another, a screwdriver or similar instrument is inserted into the slot 62 and the spool and shaft are forced against the action of the spring 64, to the right when viewed as in FIG. 1, to the phantom position shown in dotted lines. In that position, the square portion 60 is clear of the flange 56 and the spool can be rotated by rotating the shaft. For example, if the shaft were to be rotated in the counterclockwise direction when viewed in FIG. 2, the cable 46 and 30 would be let out and the spring 18 would begin pulling the blades from the folded open condition to the unfolded closed condition. If it was desired to control them such that they would be in the position designated generally A and shown in phantom lines, then when they reached that position, the pressure being exerted in the direction of the axial arrow C in FIG. 2 would be released so that the spring 64 could drive the spool and shaft to the left and again engage the square portion 60 in the flange 56. In this position, the spool would be again locked from further rotational movement. It will now be appreciated that the flow of air through the duct 10 will be somewhat more restricted than it was when the blades were fully folded, but will be as restricted as would be the case when the blades are fully unfolded and the passage is completely blocked. Thus, the volume of air passing through the frame and the duct is controlled.

It will further be noted that the fire link 44 which reacts under increased temperature conditions is always exposed upstream of the damper to the air flow conditions, no matter what position the damper is in, so that this device provides, in combination, a volume control damper and a fully operative fire damper.

In addition, the device is specifically designed to be incorporated close to the terminal portion of the air duct, wherein there will commonly be found a diffuser or grille or the like, such as that shown partially in section at 70. In such a case, it may be desirable to provide a clearance hole, such as that shown at 72, so that the slot 62 is accessible through the diffuser, thereby providing an access means for operating the volume controller.

Figure 4:
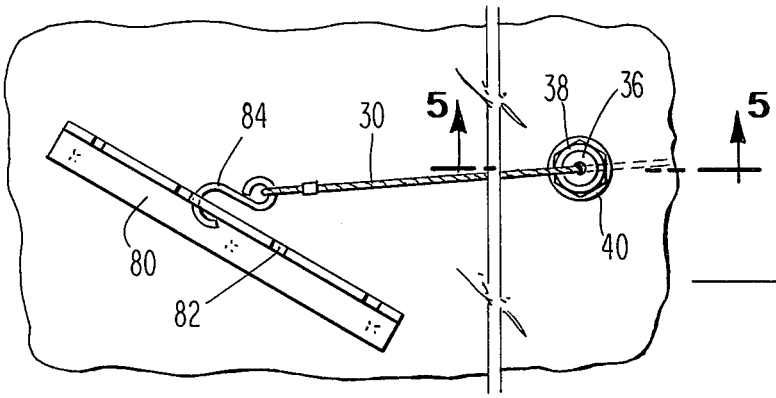
FIG. 4 is a top view of a portion of the device shown in FIG. 3.
Figure 3:
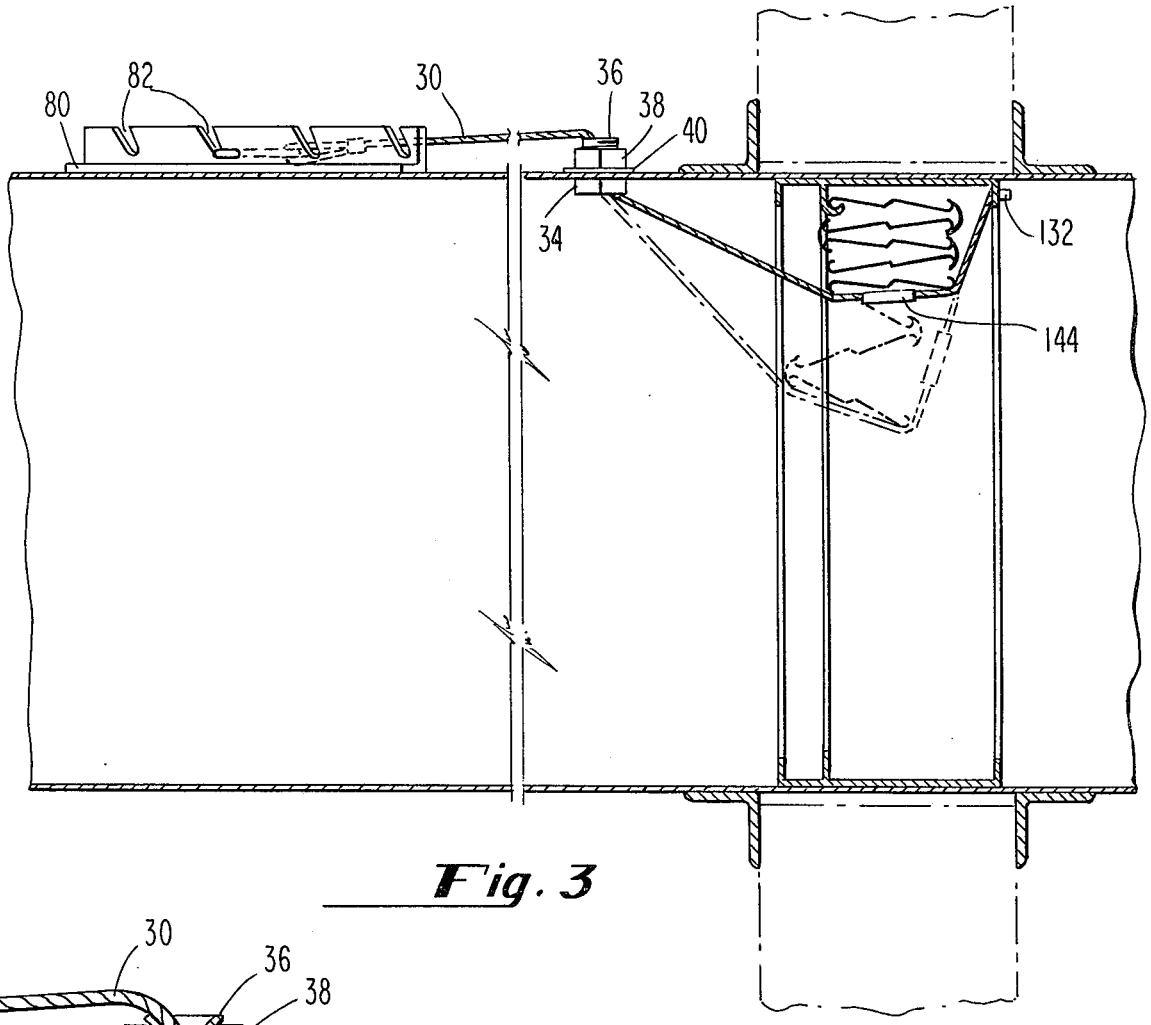
FIG. 3 is a view of an alternate embodiment of my invention and is an elevation taken from the reverse side, similar to FIG. 1, with alternate positions shown in phantom lines, the whole being foreshortened for the sake of clarity.

In the alternate embodiment shown in FIGS. 3 and 4, I have provided a means whereby the position of the damper can be fixed from outside of the duct, and also can be fixed to a plurality of predetermined positions. In such a case, the positions could be marked directly on the cable by any suitable indicator means, or they could be marked on the bracket 80, which has an upright portion having a plurality of open ended U-shaped grooves 82 for reception of one end of a hook 84, attached to one end of the cable 30. The cable again passes through a ferrule, as previously described, and has a link 144 and is attached to the frame of the damper by passing it through a portion of that frame and crimping to it a stop 132. This system, of course, gives much less flexibility in terms of the degree to which the damper can be adjusted.

It should be apparent from what has been described, that this device provides the means for carrying out the desirable object listed above, namely, it combines the desirable ends of a fire damper, a volume control damper and a diffuser into one simple and effective piece of equipment. It also provides greater versatility for use in air systems which require the damper to be fully closed at various times. Rather than releasing the link 44 to fully close the damper, the damper can be closed by means of the volume controller. Also, there is the added advantage of the structure shown of the bottom blade ramp or cam, which insures a close fit to completely close off, as near as practical, the air flow through the duct. It will be noted in this regard that a weighted blade, as is known in the art, could also be used in place of the spring 18. However, the spring is particularly useful for blades moving in a horizontal plane.

It will be understood that various changes in the details, materials and arrangement of parts which have been herein described and illustrated in order to explain the nature of this invention may be made by those skilled in the art within the principle and scope of the invention as expressed in the following claims. For example, a plurality of cables should be used, depending on such factors as the width of the damper.

It will further be understood that the "Abstract of the Disclosure" set forth above is intended to provide a non-legal technical statement of the contents of the disclosure in compliance with the Rules of Practice of the United States Patent Office, and is not intended to limit the scope of the invention described and claimed herein.

What is claimed is:

1. A volume control fire damper comprising:

a. a frame;

b. a plurality of blades articulated with respect to one another and with respect to said frame so that they can be moved between the limiting conditions of fully folded wherein the damper is open to allow the maximum passage of air through the frame and fully unfolded wherein the damper is closed to prevent the passage of air through the frame;

c. retracting means connected to said blades to move said blades from an unfolded condition to a folded condition, said retracting means comprising a cable attached to said blades;

d. link means connected to said retracting means to release said blades from said retracting means and thereby permit the blades to move to an unfolded condition; and e. adjustable volume controller means connected to said retracting means to position the blades at a plurality of fixed positions between a fully folded and fully unfolded condition, said volume controller means comprising a frame fixed with respect to said first mentioned frame, having a shaft mounted for rotation therein, said shaft being in engagement with said cable, such that said cable retracts upon rotation of said shaft in one direction and advances upon rotation of said shaft in the opposite direction, and means engaging said shaft to fix the position of said shaft in a plurality of positions.

2. The invention of claim 1 wherein said damper frame is mounted in an air duct and a diffuser is provided adjacent said controller means and positioned transversely across the end of said duct, said diffuser having access means therein to allow adjustment of said controller means from the side of said diffuser opposite to the side which is in closest proximity to said controller.

3. A volume control fire damper comprising:

a. a frame;

b. a plurality of blades articulated with respect to one another and with respect to said frame so that they can be moved between the limiting conditions of fully folded wherein the damper is open to allow the maximum passage of air through the frame and fully unfolded wherein the damper is closed to prevent the passage of air through the frame;

c. retracting means connected to said blades to move said blades from an unfolded condition to a folded condition;

d. link means connected to said retracting means to release said blades from said retracting means and thereby permit the blades to move to an unfolded condition; and e. adjustable volume controller means connected to said retracting means to position the blades at a plurality of fixed positions between a fully folded and fully unfolded condition, comprising a frame having a shaft mounted for rotation therein, said shaft being in engagement with said retracting means, such that said retracting means retracts upon rotation of said shaft in one direction and advances upon rotation of said shaft in the opposite direction; and means engaging said shaft to fix the position of said shaft in a plurality of positions, comprising a portion of said shaft in mating condition with a portion of the frame having the shaft mounted therein, to prevent rotation, said portion of said shaft being movable with said shaft out of engagement with said last mentioned frame to permit rotation, and a spring for normally urging said portion into engagement with said frame.

4. The invention of claim 3 wherein said shaft is slotted at one end to permit engagement of a tool for forcing said shaft to move with respect to said frame so that said portion can be disengaged with said frame, and to permit controlled rotation of said shaft in either direction upon rotation of said tool.

* * * * *